US007690901B2

(12) United States Patent
Achtelik et al.

(10) Patent No.: US 7,690,901 B2
(45) Date of Patent: Apr. 6, 2010

(54) HELICAL SCREW COMPRESSOR COMPRISING A COOLING JACKET

(75) Inventors: Carsten Achtelik, Dinslaken (DE); Dieter Hüttermann, Hünxe (DE); Michael Besseling, Hünxe (DE); Norbert Henning, Mülheim (DE)

(73) Assignee: GHH Rand Schraubenkompressoren GmbH, Oberhausen (DE)

( * ) Notice: Subject to any disclaimer, the term of this patent is extended or adjusted under 35 U.S.C. 154(b) by 0 days.

(21) Appl. No.: 12/094,363

(22) PCT Filed: Jun. 9, 2006

(86) PCT No.: PCT/EP2006/005557

§ 371 (c)(1),
(2), (4) Date: May 20, 2008

(87) PCT Pub. No.: WO2007/065485

PCT Pub. Date: Jun. 14, 2007

(65) Prior Publication Data

US 2008/0286138 A1 Nov. 20, 2008

(30) Foreign Application Priority Data

Dec. 8, 2005 (DE) ..... 10 2005 058 698

(51) Int. Cl.
*F04C 2/00* (2006.01)
*F04C 27/02* (2006.01)

(52) U.S. Cl. ..... 418/101; 418/85; 418/92; 418/95; 418/201.1

(58) Field of Classification Search ..... 418/101, 418/201.1, 181, 85, 92, 95, 96; 417/312, 417/410.4

See application file for complete search history.

(56) References Cited

U.S. PATENT DOCUMENTS 2,849,988 A * 9/1958 Hans ..... 418/94
3,138,320 A * 6/1964 Lauritz ..... 418/201.1
3,407,996 A 10/1968 Olofsson et al.

(Continued)

FOREIGN PATENT DOCUMENTS

DE 1147443 B * 4/1963

(Continued)

*Primary Examiner*—Theresa Trieu
(74) *Attorney, Agent, or Firm*—Michael Best & Friedrich LLP

(57) ABSTRACT

A screw compressor rotor housing is surrounded by a cooling housing that forms an annular cooling chamber. The cooling chamber is interrupted at one point by a separating wall that connects the rotor housing to the cooling housing. Coolant is fed at an inlet opening and is directed at the bottom side of the separating wall by an entrance channel, is redirected, and flows around the rotor housing until it reaches the top side of the separating wall. The coolant is redirected and is withdrawn through an exit channel that runs upward to the outlet opening. A bleed opening in the wall of the entrance channel and a vent opening in the wall of the exit channel allow for a residual amount of air to remain in the cooling chamber when it is filled with coolant, and for a residual fluid to remain when it is emptied.

9 Claims, 3 Drawing Sheets

U.S. PATENT DOCUMENTS

| | | | | | |
|---|---|---|---|---|---|
| 4,076,468 | A | | 2/1978 | Persson et al. | |
| 4,487,563 | A | * | 12/1984 | Mori et al. | 418/201.1 |
| 4,767,284 | A | * | 8/1988 | Shiinoki et al. | 418/201.1 |
| 4,781,553 | A | | 11/1988 | Nomura et al. | |
| 4,984,974 | A | * | 1/1991 | Naya et al. | 418/201.1 |
| 5,836,753 | A | | 11/1998 | Takei et al. | |
| 6,287,100 | B1 | | 9/2001 | Achtelik et al. | |
| 6,416,302 | B1 | | 7/2002 | Achtelik et al. | |
| 6,478,560 | B1 | | 11/2002 | Bowman | |
| 6,572,354 | B2 | * | 6/2003 | Kammhoff et al. | 418/201.1 |
| 6,991,440 | B2 | | 1/2006 | Achtelik et al. | |
| 2002/0081213 | A1 | | 6/2002 | Takahashi et al. | |

FOREIGN PATENT DOCUMENTS

| | | | |
|---|---|---|---|
| DE | 29922878 | U1 | 5/2001 |
| EP | 0582185 | A | 2/1994 |
| JP | 5231361 | | 9/1993 |
| JP | 11223191 | A | 8/1999 |
| JP | 05231362 | A | 9/2008 |
| WO | 2004083643 | A1 | 9/2004 |

* cited by examiner

HELICAL SCREW COMPRESSOR COMPRISING A COOLING JACKET

RELATED APPLICATION DATA

This application claims priority from German Patent Application No. 10 2005 058 698.8, filed Dec. 8, 2005, and PCT Application No. PCT/EP2006/005557, filed Jun. 9, 2006, both of which are incorporated by reference herein.

BACKGROUND

The invention pertains to a screw compressor with a rotor housing in which two screw rotors that mesh with one another with screw-shaped ribs and grooves are rotatably held with parallel axes, and with a cooling housing that surrounds the rotor housing at a distance, forming a cooling chamber together with the rotor housing, said cooling housing having an inlet opening and an outlet opening for a coolant flowing through the cooling chamber.

A screw compressor of this type is known from DE 201 10 360.5 U1 as part of a two-stage screw compressor for example.

The invention has particular advantages when applied to a screw compressor that compresses a gaseous medium such as air to very high pressures in the range of 30 to 50 bar, in particular about 40 bar, and in which the application involves the high pressure stage of a two or three stage compressor system in particular. Consequent with the compression to very high pressures is significant heating of the gaseous medium so that especially effective cooling is desired.

It is therefore an object of the invention to design a screw compressor of the type indicated that has an especially effective cooling system. Another object is to construct the screw compressor such that the emptying and filling of the cooling chamber with coolant is especially simple.

Through the invention, the coolant in the cooling chamber flows around the external surface of the rotor housing over nearly 360° of its periphery. Furthermore, the coolant sharply reverses its direction when it flows into the cooling chamber and again prior to flowing out; this redirection occurs at the separating wall that connects the rotor housing to the cooling jacket. What was discovered is that in this way, a very intensive cooling effect is accomplished, in particular near the separating wall, which acts like a cooling rib.

SUMMARY

In one construction, the invention provides a screw compressor with a rotor housing (1) in which two screw rotors (3, 5) are rotatably held. A cooling housing (21) surrounds the rotor housing at a distance. The cooling housing forms a cooling chamber (27) together with the rotor housing (1) and has at least one inlet opening (31) and one outlet opening (33) for a fluid coolant that flows through the cooling chamber. The screw compressor is characterized in that the cooling chamber (27) surrounds the rotor housing (1) as an annulus essentially along its entire periphery, being interrupted at only one point by a separating wall (29) that connects the rotor housing (1) to the cooling housing (21), and that an entrance channel (35) is connected to the inlet opening (31) from which the coolant flows into the cooling chamber (27) with a flow direction that is essentially perpendicular to and directed at a lateral surface of the separating wall (29), and that an exit channel (37) is located prior to the outlet opening (33). The exit channel has an entrance opening (37') that is situated essentially perpendicular and opposite to the other lateral surface of the separating wall (29), such that the coolant fed first impinges upon one side of the separating wall (29) and is redirected at this location, whereupon it flows around the rotor housing for approximately 360° of its periphery and then is again redirected at the other side of the separating wall (29) and withdrawn through the exit channel.

BRIEF DESCRIPTION OF THE DRAWINGS

One embodiment of the invention is explained in more detail with the help of the drawings. Shown are.

DETAILED DESCRIPTION

Figure 1:
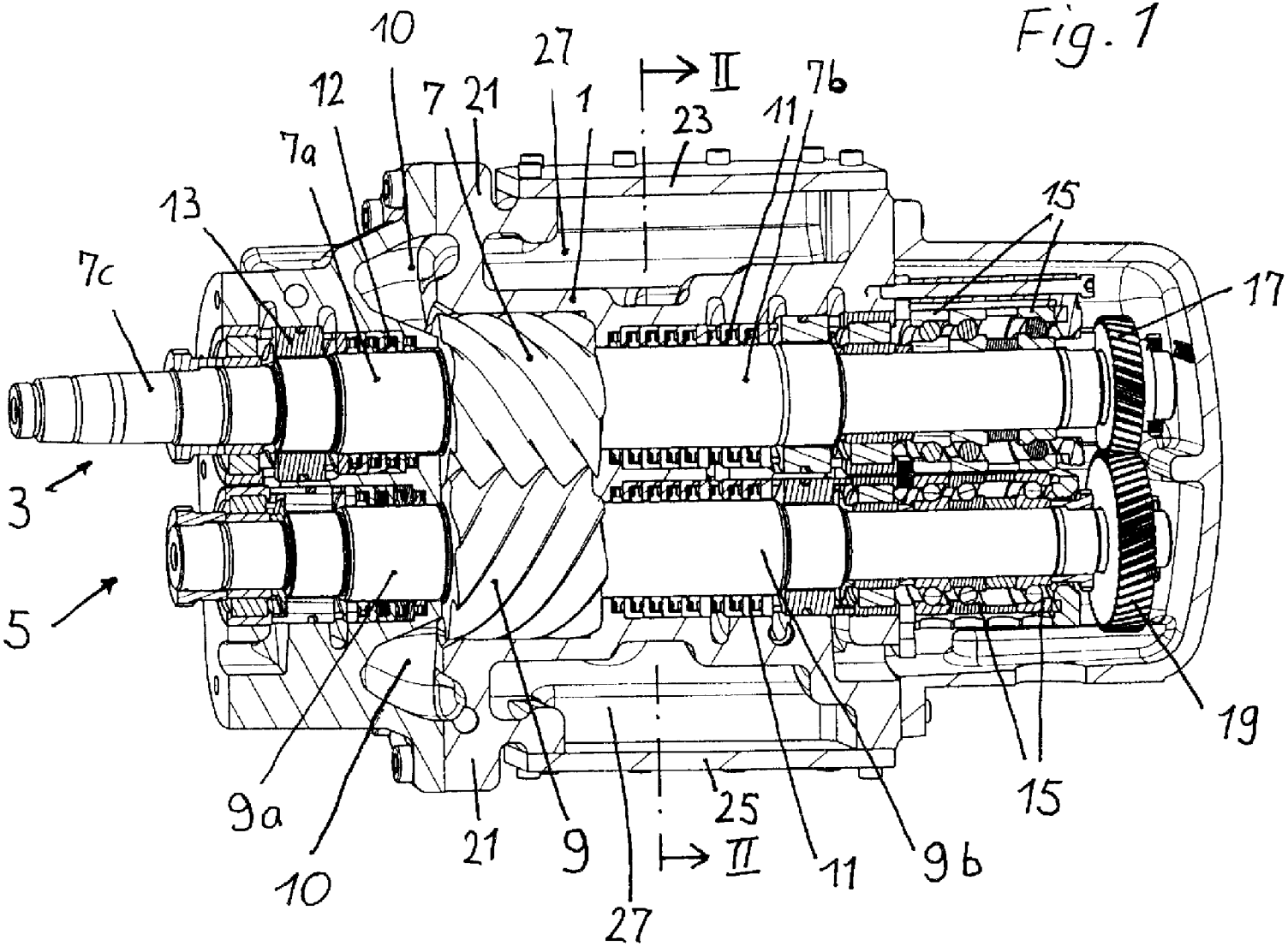
FIG. 1 a perspective, partial sectional view of the screw compressor according to one embodiment of the invention FIG. 2 a cross section of the screw compressor of FIG. 1, approximately along the sectional line II-II of FIG. 1, FIG. 3 a section essentially along line III-III of FIG. 2.

The screw compressor shown in FIG. 1 has a rotor housing 1 shown in a sectional view, in which two rotors 3 and 5 are rotatably held with parallel axes. The rotating axes of the rotors 3, 5 lie in a common vertical plane that is also the sectional plane used to illustrate the rotor housing 1. Each rotor has a profile section 7 and 9 with a profile that contains screw-shaped ribs and grooves, wherein the ribs and grooves of the two profile sections 7, 9 mesh with one another and form a seal thereby. On both sides of the profile sections 7, 9 are shaft pins 7*a*, 7*b*, 9*a*, 9*b*, the surfaces of which cooperate with seal arrangements 11, 12 to seal the rotor in the rotor housing 1. The shaft pins 7*a*, 7*b*, 9*a*, 9*b* are also rotatably held in the rotor housing 1 with bearings 13, 15.

The upper rotor 3 in FIG. 1 is the main rotor, at the left end of which in FIG. 1 is an extension 7*c* of its shaft pin provided to support a drive gear (not shown) that meshes with a corresponding gear in a drive transmission unit (not shown) in order to turn the rotor 3.

At the right end in FIG. 1, the two rotors 3, 5 have two gears 17, 19 that mesh with one another, thus forming a set of synchronization gears that conveys the rotation of the upper rotor 3 to the lower rotor 5, which is the secondary rotor, at the desired RPM ratio.

When the screw compressor shown in FIG. 1 is operated, the gas to be compressed, in particular air, is fed to its intake chamber 10, which is located at the left end of the profile sections 7 and 9 in the rotor housing 1 in FIG. 1 and is connected to an inlet nozzle (not shown). It is preferable if the incoming gas has already been pre-compressed to an intermediate pressure by one or more upstream compressor stages (not shown), for example a pressure in the range of 10 to 15 bar, preferably about 12 bar. This pre-compressed gas is conveyed to the right in FIG. 1 through the profile sections 7, 9 of the two rotors 3, 5 and in the process compressed to a final pressure, which is preferred to be in the range of 30 to 50 bar, in particular about 40 bar. The compressed gas leaves the rotor housing 1 through an outlet (not shown) at the right, pressurized end of the profile sections 7, 9 in FIG. 1.

Rotor housing 1 is surrounding by a cooling jacket or cooling housing 21, which is for the most part designed as one-piece together with rotor housing 1, surrounding the same at a distance. Above and below, the cooling housing 21 has large openings that are closed off using a cover plate 23 and a base plate 25 fastened with bolts. Between the rotor housing 1 and the cooling housing 21, 23, 25 is an annular cooling chamber 27 that surrounds the rotor housing 1.

Figure 2:
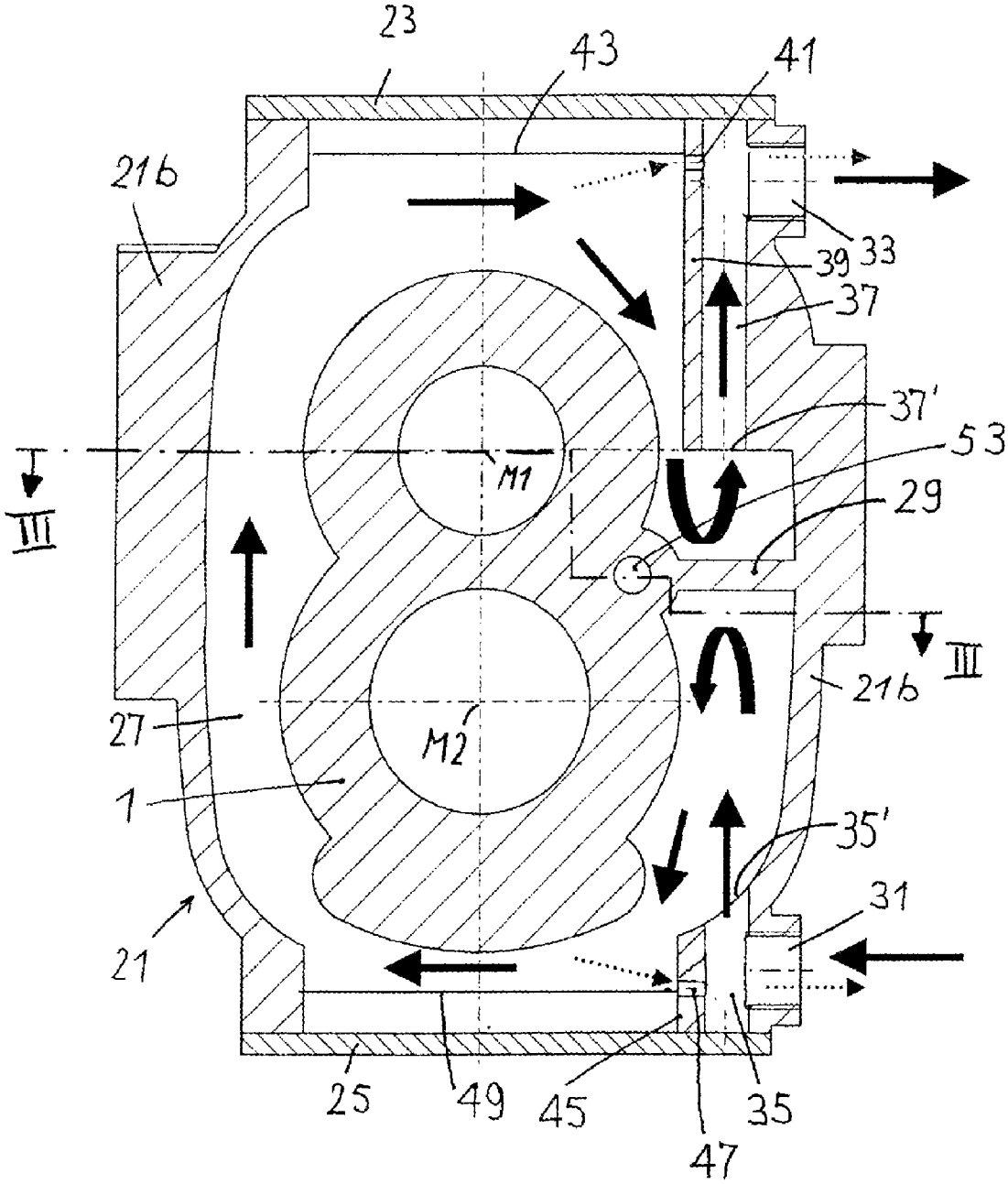

FIG. 2 shows a simplified schematic illustration of a cross section approximately along line II-II of FIG. 1. The rotor housing 1 that houses the screw rotors (not shown) is surrounded by the cooling jacket or cooling housing 21, the side walls 21*a*, 21*b* of which are designed preferably in one piece with the rotor housing 1 and which is closed above and below by cover 23 and by base plate 25. Together with the rotor housing 1, the cooling housing 21 forms an essentially complete annular cooling chamber 27 that surrounds the rotor housing 1; this chamber is only interrupted at one point by a separating wall 29 that connects the rotor housing 1 to the side wall 21*b* of the cooling housing 21. The separating wall 29 runs horizontally approximately halfway between the center points of the axes M1, M2 of the screw rotors that are arranged perpendicular one on top of the other.

The cooling housing 21 has an inlet opening 31 and an outlet opening 33 for coolant fluid, e.g. cooling water or oil. The inlet opening 31 opens up into a perpendicular entrance channel 35 that runs upward, the upper exit opening 35' of which is situated opposite the bottom of the separating wall 29 at a distance. Prior to the outlet opening 33 is a perpendicular exit channel 37, the lower entrance opening 37' of which is situated opposite the top of the separating wall 29 at a distance.

The black arrow in FIG. 2 identifies the flow path of the coolant fed to the inlet opening 31. It is directed through the entrance channel 35 perpendicular upward toward the bottom of the separating wall 29, turns sharply away from the wall and then flows downward and around the entire periphery of the rotor housing 1, clockwise in FIG. 2, until it meets the top of the separating wall 29, where it turns sharply away from the wall upward and is withdrawn through the exit channel 37 and the outlet opening 33.

There is a small vent opening 41 in the wall 39 that separates the exit channel 37 from the cooling chamber 1 at a height that roughly corresponds to the upper edge of the outlet opening 33. While filling the cooling chamber 27 with coolant, this vent opening 41 allows air to escape, as indicated in FIG. 2 by the upper dotted arrow, so that the cooling chamber 27 can be filled up to the height of the vent opening 41, i.e. up to the fluid level indicated by line 43, and so that the volume of the included residual air above the fluid level 43 is very low.

A very small bleed opening 47 is placed in the wall 45 that separates the entrance channel 35 from the cooling chamber 27 at the level of the lower edge of the inlet opening 31. When the cooling fluid is emptied from the cooling chamber 27, cooling fluid can drain out (as indicated by the lower dotted arrow in FIG. 2) through the bleed opening 47 and the inlet opening 31 until the cooling fluid level in the cooling chamber 27 has reached the level of the bleed opening 47, i.e. until it has dropped to the level indicated by line 49. The amount of cooling fluid remaining below line 49 is therefore very low when the cooling chamber 27 is emptied.

Figure 3:
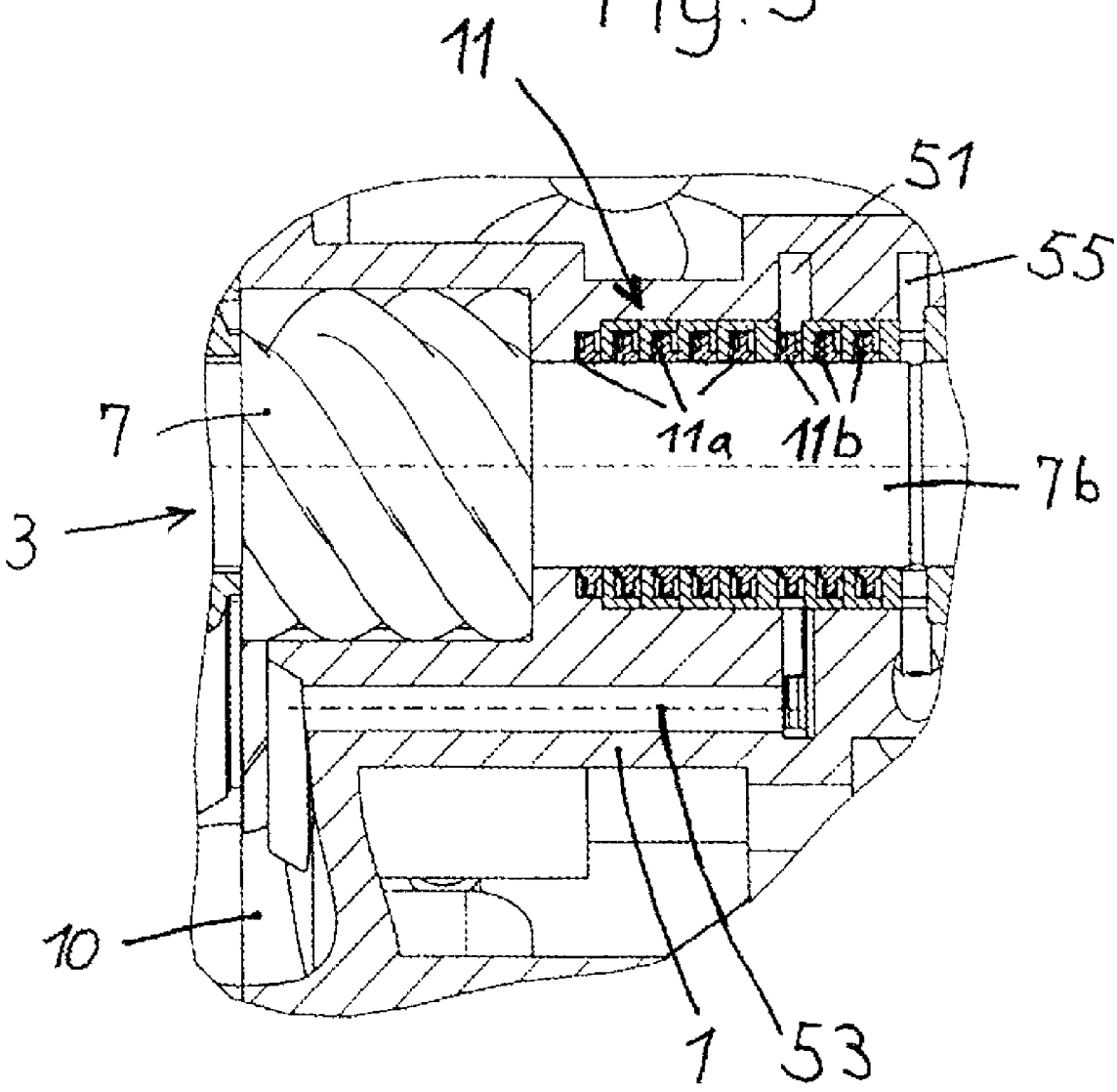

FIG. 3 shows other details of the invention that relate to the seal arrangement 11 shown in FIG. 1 to seal the shaft pins 7*b*, 9*b* of the rotors 3, 5 in the rotor housing on the pressurized side. As shown, the seal arrangement 11 consists of a number of radial seal rings 11*a*, 11*b* in series. In the embodiment shown, eight radial seal rings 11*a*, 11*b* are arranged one after the other. These radial seal rings 11*a*, 11*b* can be lip seal rings, as is preferred, and as are known from EP 0 993 553, for example. The sealing arrangement 11 is surrounded by a first annular relief chamber 51 to capture any gas that has leaked through the seals 11*a*, said chamber placed at a suitable location between a first number of radial seal rings 11*a* and a second number of radial seal rings 11*b*. In the embodiment of FIG. 3 with eight radial seal rings, it can be advantageous to place the relief chamber 51 between the first number of five seal rings 11*a*, seen as beginning from the rotor profile 7, and the last three, in other words the outer radial seal rings 11*b*.

The relief chamber 51 is connected to the intake chamber 10 of the screw compressor via a connection channel 53 incorporated into the rotor housing 1 parallel to the rotor axis. The annular relief chamber 51 is thus subject to the intake pressure of the screw compressor present in the intake chamber 10. In the preferred use of the screw compressor as a high pressure stage of a multistage compressor system, the air fed to the intake chamber 10 can have already been pre-compressed by the upstream compressor stages to a pressure of between 10 and 15 bar, for example, in particular about 12 bar; this, then, is the pressure that is present in the relief chamber 51. As the compressor is operated, the high final pressure produced by the rotors, for example 40 bar, must drop to zero through the sealing arrangement 11*a*, 11*b*. It has been shown that this pressure drop is not linear, but concentrates primarily on the outer radial seal rings 11*b* that are a distance away from the profile section 7, 9 and therefore these seals are very heavily loaded mechanically. A defined intermediate pressure is established by the first relief chamber 51 since it is subject to the compressor inlet pressure at a defined point along the sealing arrangement; thus the pressure drop along the entire sealing arrangement 11*a*, 11*b* is smoothed out. This relieves the mechanical load on seals 11*b*.

A second annular relief chamber 55 is provided at the far end of the sealing arrangement 11 away from the rotor. This chamber is connected to the atmosphere in a known fashion. The purpose of this second relief chamber 55 is to maintain the oil system that lubricates the bearings 15 and the synchronization gears 17, 19 at zero pressure and to prevent bleed gas from passing through the sealing arrangement 11 through to the oil-lubrication areas.

As shown in FIG. 2, the connection channel 53 that connects relief chamber 51 to the intake chamber 10 runs inside the rotor housing 1, preferably in the direct vicinity of the separating wall 19 that connects the rotor housing 1 to the cooling housing 21. Thanks to the intensive cooling of the separating wall 29, which acts like a cooling rib, by the coolant that is redirected by it, the connecting channel 53, and thus the bleed gas flowing through it to the intake chamber 10, is also subjected to especially intensive cooling.

The invention claimed is:

1. Screw compressor with a rotor housing (1) in which two screw rotors (3, 5) are rotatably held, a cooling housing (21) that surrounds the rotor housing at a distance, said cooling housing forming a cooling chamber (27) together with the rotor housing (1) and having at least one inlet opening (31) and one outlet opening (33) for a fluid coolant that flows through the cooling chamber, characterized in that the cooling chamber (27) surrounds the rotor housing (1) as an annulus essentially along its entire periphery, being interrupted at only one point by a separating wall (29) that connects the rotor housing (1) to the cooling housing (21), and that an entrance channel (35) is connected to the inlet opening (31) from which the coolant flows into the cooling chamber (27) with a flow direction that is essentially perpendicular to and directed at a lateral surface of the separating wall (29), and that an exit channel (37) is located prior to the outlet opening (33), said exit channel having an entrance opening (37') that is situated essentially perpendicular and opposite to another lateral surface of the separating wall (29), such that the coolant fed first impinges upon one side of the separating wall (29) and is redirected at this location, whereupon it flows around the rotor housing for approximately 360° of its periphery and then is again redirected at the other side of the separating wall (29) and withdrawn through the exit channel.

2. Screw compressor according to claim 1, wherein the separating wall (29) runs horizontally, the incoming coolant is directed essentially vertically upward at a bottom of the separating wall through the entrance channel (35) and after flowing around the rotor housing (1) is again redirected vertically upward by a top of the separating wall (29) into the exit channel.

3. Screw compressor according to claim 2, characterized in that a small bleed opening (47) is placed in the wall of the entrance channel (35) at a small distance from a bottom wall (25) of the cooling housing (21).

4. Screw compressor according to claim 2, wherein a small vent opening (41) is placed in the wall of the exit channel (37) at a small distance from an upper wall (23) of the cooling housing.

5. Screw compressor according to claim 1, wherein a small bleed opening (47) is placed in the wall of the entrance channel (35) at a small distance from a bottom wall (25) of the cooling housing (21).

6. Screw compressor according to claim 5, wherein a small vent opening (41) is placed in the wall of the exit channel (37) at a small distance from an upper wall (23) of the cooling housing.

7. Screw rotor according to claim 6, wherein the screw rotors (3, 5) include shaft pins (7*b*, 9*b*), and wherein a connecting channel (53) is placed in the wall of the rotor housing 1 in the vicinity of the separating wall (29) that connects the rotor housing to the cooling housing (21), said connecting channel connecting a relief chamber (51) that surrounds a sealing arrangement (11) to seal off a pressurized side of the shaft pins (7*b*, 9*b*) of the screw rotors (3, 5) in the rotor housing to an intake chamber (10) of the screw compressor.

8. Screw compressor according to claim 1, wherein a small vent opening (41) is placed in the wall of the exit channel (37) at a small distance from an upper wall (23) of the cooling housing.

9. Screw rotor according to claim 1, wherein the screw rotors (3, 5) include shaft pins (7*b*, 9*b*), and wherein a connecting channel (53) is placed in the wall of the rotor housing 1 in the vicinity of the separating wall (29) that connects the rotor housing to the cooling housing (21), said connecting channel connecting a relief chamber (51) that surrounds a sealing arrangement (11) to seal off a pressurized side of the shaft pins (7*b*, 9*b*) of the screw rotors (3, 5) in the rotor housing to an intake chamber (10) of the screw compressor.

* * * * *